US008172552B2

(12) United States Patent
Fukanuma et al.

(10) Patent No.: US 8,172,552 B2
(45) Date of Patent: May 8, 2012

(54) VARIABLE DISPLACEMENT COMPRESSOR

(75) Inventors: Tetsuhiko Fukanuma, Kariya (JP); Hiroaki Kayukawa, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 32 days.

(21) Appl. No.: 12/001,512

(22) Filed: Dec. 11, 2007

(65) Prior Publication Data

US 2008/0166245 A1 Jul. 10, 2008

(30) Foreign Application Priority Data

Dec. 13, 2006 (JP) ..... 2006-335653

(51) Int. Cl.
*F04B 1/32* (2006.01)
*F04B 39/06* (2006.01)

(52) U.S. Cl. ..... 417/222.2; 417/228; 417/292; 417/440

(58) Field of Classification Search ..... 184/6.17; 417/222.2, 228, 292, 440
See application file for complete search history.

(56) References Cited

U.S. PATENT DOCUMENTS

| | | | | |
|---|---|---|---|---|
| 6,162,026 | A | 12/2000 | Kimura et al. | 417/222.2 |
| 6,332,757 | B1 | 12/2001 | Kaneko et al. | |
| 6,659,733 | B1 * | 12/2003 | Takenaka et al. | 417/222.1 |
| 7,293,965 | B2 | 11/2007 | Tabuchi et al. | |
| 2001/0053327 | A1 | 12/2001 | Yokomachi et al. | |
| 2004/0005223 | A1 * | 1/2004 | Kawachi et al. | 417/222.1 |

FOREIGN PATENT DOCUMENTS

| | | | |
|---|---|---|---|
| EP | 0256793 | * | 8/1987 |
| EP | 1 052 406 A2 | | 11/2000 |
| JP | 62-91672 | | 4/1987 |
| JP | 64-066477 | | 3/1989 |
| JP | 03-100381 | | 4/1991 |
| JP | 05-14570 U | | 2/1993 |
| JP | 11-159449 | | 6/1999 |
| JP | 2001-123946 | | 5/2001 |
| JP | 2001-355570 A | | 12/2001 |
| JP | 2002-310064 | * | 10/2002 |
| JP | 2004-308633 A | | 11/2004 |

OTHER PUBLICATIONS

Korean Office Action dated Dec. 13, 2008 corresponding to Korean Patent Application No. 2007-0128212.
Japanese Office Action mailed on Feb. 10, 2009, for Japanese Patent Application No. 2006-335653 (No English translation provided).
European Search Report for Application No. 07122828.2-2315/1936191 dated Mar. 3, 2010.

* cited by examiner

*Primary Examiner* — Devon C Kramer
*Assistant Examiner* — Bryan Lettman
(74) *Attorney, Agent, or Firm* — Locke Lord LLP

(57) ABSTRACT

A variable displacement compressor that draws refrigerant from a suction pressure zone and discharges the refrigerant to a discharge pressure zone, and controls displacement according to a pressure in a control pressure chamber. The compressor has a cam body, pistons, a supply passage, a release passage, and an on-off valve. The inclination angle of the cam body is changeable based on the pressure in the control pressure chamber. A piston reciprocates in each cylinder bore as the cam body rotates. The supply passage supplies the refrigerant in the discharge pressure zone to the control pressure chamber. The release passage releases the refrigerant in the control pressure chamber to the suction pressure zone. The on-off valve selectively opens and closes the release passage in response to changes of the temperature. The on-off valve shuts off the release passage when the temperature is equal to or higher than a predetermined temperature.

8 Claims, 2 Drawing Sheets

10
11
12
13
14
15
16
17
18
19
20
21
22
23
24
25
26
27
28
29 (31)
30
32
33
34
35
36
37
38
39
111
112
114
121
131
132
141
142
151
161
171
181
182 (31)
183 (31)
291
C
E

VARIABLE DISPLACEMENT COMPRESSOR

BACKGROUND OF THE INVENTION

The present invention relates to a variable displacement compressor, and more particularly, to an improvement of lubrication performance.

When a compressor operates with insufficient refrigerant, the temperature of the refrigerant might become abnormally high. In this case, the lubricant contained in the refrigerant is reduced. In the variable displacement compressors disclosed in Japanese Laid-Open Patent Publication No. 62-91672 and Japanese Laid-Open Patent Publication No. 3-100381, the amount of lubricant contained in refrigerant sent from the discharge pressure zone to the control pressure chamber is small, the amount of lubricant sent to the control pressure chamber is insufficient. If the compressor operates at a large displacement, that is, with a great inclination angle of the swash plate, when there is insufficient lubricant, seizing may occur between the swash plate and the shoes.

The variable displacement compressor disclosed in Japanese Laid-Open Patent Publication No. 62-91672 has a pressure controlling section that incorporates a shape changing member between a discharge chamber and a signal pressure chamber (control pressure chamber). The shape changing member includes a spring made of a shape memory alloy that responds to temperature. When the temperature of refrigerant is equal to or higher than a predetermined temperature, the urging force of the spring is rapidly increased so that a high pressure valve of the pressure controlling section is opened. When the high pressure valve is open, the amount of refrigerant sent from the discharge chamber to the signal pressure chamber increases. Accordingly, the pressure in the signal pressure chamber increases, and the inclination angle of the wobble plate is reduced. As a result, the seizing between the swash plate and the shoes is avoided.

In the variable displacement compressor disclosed in Japanese Laid-Open Patent Publication No. 62-91672, when the temperature of refrigerant is equal to or higher than a predetermined temperature, the amount of refrigerant sent to the signal pressure chamber is increased, so that the inclination angle of the wobble plate is reduced. On the other hand, in the compressor disclosed in Japanese Laid-Open Patent Publication No. 62-91672, the refrigerant in the signal pressure chamber flows out to the suction chamber through a release passage. As a result, in order to maintain a small inclination angle of the wobble plate, refrigerant needs to be constantly supplied to the signal pressure chamber at a great flow rate. However, since the temperature of the refrigerant is high, constantly supplying the refrigerant to the signal pressure chamber can have an adverse influence on the reliability of sliding members.

Also, since the refrigerant in the signal pressure chamber flows out to the suction chamber, lubricant flows out of the signal pressure chamber together with the refrigerant. In addition, in a state where the temperature of the refrigerant is abnormally high, the amount of lubricant in the refrigerant has been reduced, and therefore only a small amount of lubricant is sent to the signal pressure chamber. The amount of lubricant in the signal pressure chamber will therefore be insufficient.

SUMMARY OF THE INVENTION

Accordingly, it is an objective of the present invention to provide a variable displacement compressor that prevents the amount of refrigerant from being insufficient in a control pressure chamber even if the temperature of refrigerant is abnormally high.

To achieve the foregoing objective and in accordance with one aspect of the present invention, a variable displacement compressor is provided. The compressor draws refrigerant from a suction pressure zone and discharges the refrigerant to a discharge pressure zone, and controls displacement according to a pressure in a control pressure chamber. The compressor includes a cam body, a piston, a supply passage, a release passage, and an on-off valve. The cam body is provided in the control pressure chamber. An inclination angle of the cam body is changeable based on the pressure in the control pressure chamber. The piston reciprocates in a cylinder bore as the cam body rotates. The supply passage supplies the refrigerant in the discharge pressure zone to the control pressure chamber. The release passage discharges the refrigerant in the control pressure chamber to the suction pressure zone. The on-off valve responds to changes in the temperature of the valve to selectively open and close the release passage. When the temperature of the valve is equal to or higher than a predetermined temperature, the on-off valve shuts off the release passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1A and 1B.

Figures 1A, 1B:
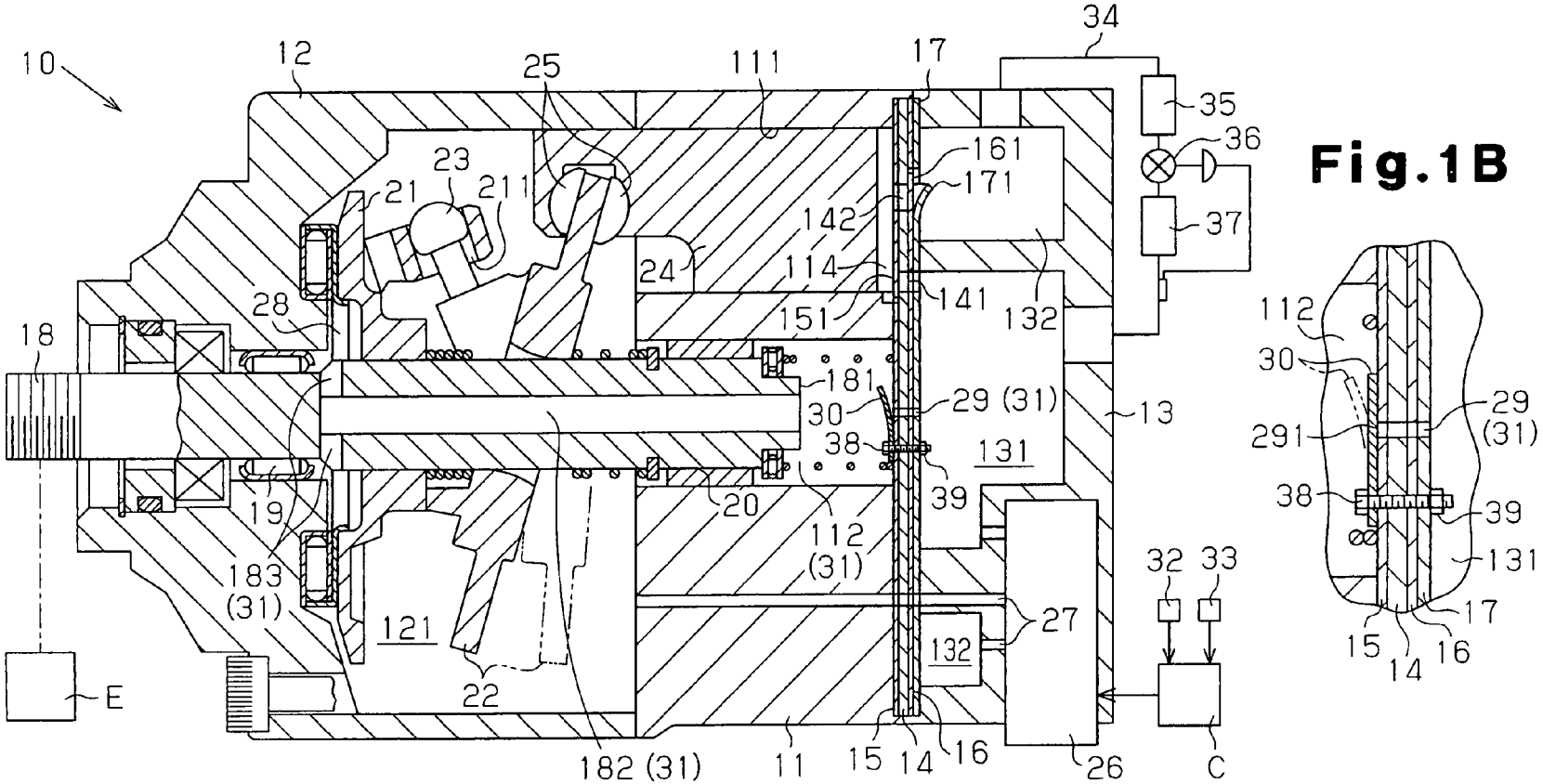
FIG. 1A is a cross-sectional side view illustrating a variable displacement compressor according to one embodiment of the present invention.
FIG. 1B is an enlarged cross-sectional view illustrating the variable displacement compressor shown in FIG. 1.

As shown in FIG. 1A, a front housing member 12 is secured to the front end of a cylinder block 11. A rear housing member 13 is secured to the rear end of the cylinder block 11 with a valve plate 14, valve flap plates 15, 16, and a retainer plate 17 arranged in between. The cylinder block 11, the front housing member 12, and the rear housing member 13 form a housing of a variable displacement compressor 10. The compressor 10 forms a part of a vehicular air conditioner.

The front housing member 12 defines a control pressure chamber 121 and rotatably supports a rotary shaft 18 with a radial bearing 19. An inner end 181 of the rotary shaft 18 is located inside a support hole 112 extending through the cylinder block 11. In the support hole 112, the rotary shaft 18 is rotatably supported by the cylinder block 11 with a plain bearing 20. The rotary shaft 18 protrudes to the outside from the control pressure chamber 121 through the front housing member 12, and receives power from a vehicle engine E, which is an external driving source to rotate.

A rotary support 21 is fixed to the rotary shaft 18, and a swash plate 22, which functions as a cam body, is supported on the rotary shaft 18. The swash plate 22 is permitted to move along and incline with respect to the axial direction of the rotary shaft 18. The swash plate 22 has guide pins 23. Each guide pin 23 is movably inserted in one of guide holes 211 formed in the rotary support 21.

The engagement of the guide holes 211 with the guide pins 23 allows the swash plate 22 to move along the axial direction of the rotary shaft 18 while being inclined, and to rotate together with the rotary shaft 18. The swash plate 22 is inclined by sliding the guide pins 23 with respect to the guide holes 211, and sliding the swash plate 22 with respect to the rotary shaft 18.

When the radial center of the swash plate 22 moves toward the rotary support 21, the inclination of the swash plate 22 increases. The inclination angle of the swash plate 22 is maximized when the rotary support 21 contacts the swash plate 22. When in a position indicated by solid lines in FIG. 1A, the swash plate 22 is at the maximum inclination position. When in a position indicated by chain lines, the swash plate 22 is at the minimum inclination position.

Cylinder bores 111 extend through the cylinder block 11. Each cylinder bore 111 accommodates a piston 24. Rotation of the swash plate 22 is converted into reciprocation of pistons 24 by shoes 25. Each piston 24 reciprocates in the associated cylinder bore 111. Each piston 24 defines a compression chamber 114 in the associated cylinder bore 111.

A suction chamber 131 and a discharge chamber 132 are defined in the rear housing member 13. Suction ports 141 are formed in the valve plate 14, the valve flap plate 16, and the retainer plate 17. Each suction port 141 corresponds to one of the cylinder bores 111. Discharge ports 142 are formed in the valve plate 14 and the valve flap plate 15. Each discharge port 142 corresponds to one of the cylinder bores 111. The valve plate 14, the valve flap plates 15, 16, and the retainer plate 17 form a partition wall that partitions the compression chambers 114 from the suction chamber 131, which is a suction pressure zone, and the discharge chamber 132, which is a discharge pressure zone.

Suction valve flaps 151 are formed on the valve flap plate 15. Each suction valve flap 151 corresponds to one of the suction ports 141. Discharge valve flaps 161 are formed on the valve flap plate 16. Each discharge valve flap 161 corresponds to one of the discharge ports 142. As each piston 24 moves from the top dead center to the bottom dead center, refrigerant in the suction chamber 131 is drawn into the associated compression chamber 114 through the corresponding suction port 141 while flexing the suction valve flap 151. When each piston 24 moves from the bottom dead center to the top dead center, gaseous refrigerant in the corresponding compression chamber 114 is discharged to the discharge chamber 132 through the corresponding discharge port 142 while flexing the discharge valve flap 161. The retainer plate 17 includes retainers 171, which correspond to the discharge valves 161. Each retainer 171 restricts the opening degree of the corresponding discharge valve flap 161.

After being discharged to the discharge chamber 132, the refrigerant flows out to an external refrigerant circuit 34 connected to the compressor 10. A heat exchanger 35 for drawing heat from the refrigerant, an expansion valve 36, and a heat exchanger 37 for transferring the ambient heat to the refrigerant are located on the external refrigerant circuit 34. After being discharged to the external refrigerant circuit 34, the refrigerant is returned to the suction chamber 131.

An electromagnetic displacement control valve 26 is installed in the rear housing member 13. The displacement control valve 26 is located in a supply passage 27, which connects the discharge chamber 132 to the control pressure chamber 121. The displacement control valve 26 regulates the flow passage area of the supply passage 27. The displacement control valve 26 has an electromagnetic solenoid (not shown). The electromagnetic solenoid is subjected to duty control, that is, excited and de-excited by the control computer C. The opening degree of the displacement control valve 26 is adjusted in accordance with the pressure in the suction chamber 131 and the duty cycle of a current supplied to the electromagnetic solenoid. Also, when the valve hole of the displacement control valve 26 is closed, the refrigerant in the discharge chamber 132 is not sent to the control pressure chamber 121.

The rotary shaft 18 has an axial passage 182. The axial passage 182 communicates with the support hole 112. A space 28 is defined between the rotary support 21 and the front housing member 12. The axial passage 182 communicates with the space 28 through vents 183, which open to the circumferential surface of the rotary shaft 18. The support hole 112 communicates with the suction chamber 131 through a communication passage 29 extending through the valve flap plates 15, 16, the valve plate 14, and the retainer plate 17. The vents 183, the axial passage 182, the support hole 112, and the communication passage 29 form a release passage 31, which connects the control pressure chamber 121 with the suction chamber 131 to release the refrigerant in the control pressure chamber 121 to the suction chamber 131 (suction pressure zone).

An on-off valve 30, which is a reed valve, is located in the support hole 112 to selectively open and close the communication passage 29. The on-off valve 30, the valve flap plate 15, 16, the valve plate 14, and the retainer plate 17 are fastened to one another with a screw 38 and a nut 39. The on-off valve 30 is made of bimetal. When the temperature of the on-off valve 30 is equal to or higher than a predetermined temperature, the on-off valve 30 contacts the valve flap plate 15 to close the inlet of the communication passage 29 as shown by solid lines in FIG. 1B. The predetermined temperature has been obtained, as a value can cause shortage of lubricant, through experiments and computer calculations.

When the on-off valve 30 shuts off the communication passage 29, that is, when the on-off valve shuts off the release passage 31, the refrigerant in the control pressure chamber 121 does not flow out to the suction chamber 131 through the release passage 31. In this state, the pressure in the control pressure chamber 121 is increased if high pressure refrigerant that has been compressed in the compression chambers 114 leaks to the control pressure chamber 121 through the clearance between the outer circumferential surface of each piston 24 and the inner circumferential surface of the corresponding cylinder bore 111. That is, even if the inclination angle of the swash plate 22 is relatively large, the inclination angle is reduced by increasing the pressure in the control pressure chamber 121, and the compressor displacement is reduced.

When the on-off valve 30 maintains an inlet 291 of the communication passage 29 open as shown in FIG. 1A, the control pressure chamber 121 communicates with the suction chamber 131 through the release passage 31. Therefore, the refrigerant in the control pressure chamber 121 flows out to the suction chamber 131 through the release passage 31 (the vents 183, the axial passage 182, the support hole 112, and the communication passage 29). When the on-off valve 30 contacts the valve flap plate 15 in an area and closes the communication passage 29, the release passage 31 is shut off. As a result, the refrigerant in the control pressure chamber 121 does not flow to the suction chamber 131 through the release passage 31.

In a state where the on-off valve 30 keeps the communication passage 29 open, if the opening degree of the displacement control valve 26 is increased, the flow rate of refrigerant flowing from the discharge chamber 132 into the control pressure chamber 121 through the supply passage 27, which increases the pressure in the control pressure chamber 121. Accordingly, the inclination angle of the swash plate 22 is reduced, and the compressor displacement is decreased. On the other hand, in a state where the on-off valve 30 is open, if the opening degree of the displacement control valve 26 is reduced, the refrigerant in the control pressure chamber 121 flows out to the suction chamber 131 through the release passage 31, the flow rate of the refrigerant that flows into the control pressure chamber from the discharge chamber 132 through the supply passage 27 is reduced. This lowers the pressure in the control pressure chamber 121, thereby increasing the inclination angle of the swash plate 22. Accordingly, the compressor displacement is increased.

The control computer C is connected to a compartment temperature setting device 32 and a compartment temperature sensor 33. The control computer C controls the opening degree of the displacement control valve 26, that is, the current to the electromagnetic solenoid of the displacement control valve 26, in such a manner that the vehicle temperature detected by the compartment temperature sensor 33 is converged to the target value set by the compartment temperature setting device 32.

The present embodiment has the following advantages.

(1) When the temperature of the refrigerant in the variable displacement compressor 10 becomes abnormally high due to, for example, in sufficient amount of refrigerant in the variable displacement compressor 10 and the external refrigerant circuit 34, the amount of lubricant in the control pressure chamber 121 might be insufficient. If the variable displacement compressor 10 is operated in a state where the amount of refrigerant in the control pressure chamber 121 is insufficient and the inclination angle of the swash plate 22 is large, seizing may occur between the swash plate 22 and the shoes 25.

When the temperature of the on-off valve 30 is equal to or higher than the predetermined temperature, the on-off valve 30 shuts off the release passage 31. The refrigerant thus does not flow out to the suction chamber 131 from the control pressure chamber 121 through the release passage 31. In this state, the pressure in the control pressure chamber 121 is increased if high pressure refrigerant that has been compressed in the compression chambers 114 leaks to the control pressure chamber 121 through the clearance between the outer circumferential surface of each piston 24 and the inner circumferential surface of the corresponding cylinder bore 111. That is, even if the swash plate 22 is inclined so that the pistons 24 reciprocate to compress refrigerant, the inclination angle of the swash plate 22 is quickly reduced by increasing the pressure in the control pressure chamber 121, so that the swash plate 22 is moved to the minimum inclination angle position shown by chain lines in FIG. 1A. Further, in a state where the on-off valve 30 keeps the communication passage 29 closed, the refrigerant in the control pressure chamber 121 does not flow out to the suction chamber 131 through the release passage 31. Thus, even if the temperature of the refrigerant is abnormally high, the lubricant in the control pressure chamber 121 does not become insufficient.

(2) The on-off valve 30 is a plate shaped reed valve the shape of which changes in response to changes in temperature. A bimetal is suitable for the material of the on-off valve 30.

(3) The on-off valve 30, which selectively opens and closes the communication passage 29 extending through the valve plate 14, is easily attached to the valve plate 14 using the screw 38 and the nut 39. The valve plate 14 having the communication passage 29, which is a part of the release passage 31, is suitable as a support portion for supporting the on-off valve 30, which selectively opens and closes the communication passage 29.

The above-mentioned embodiment may be modified as follows.

Figure 2:
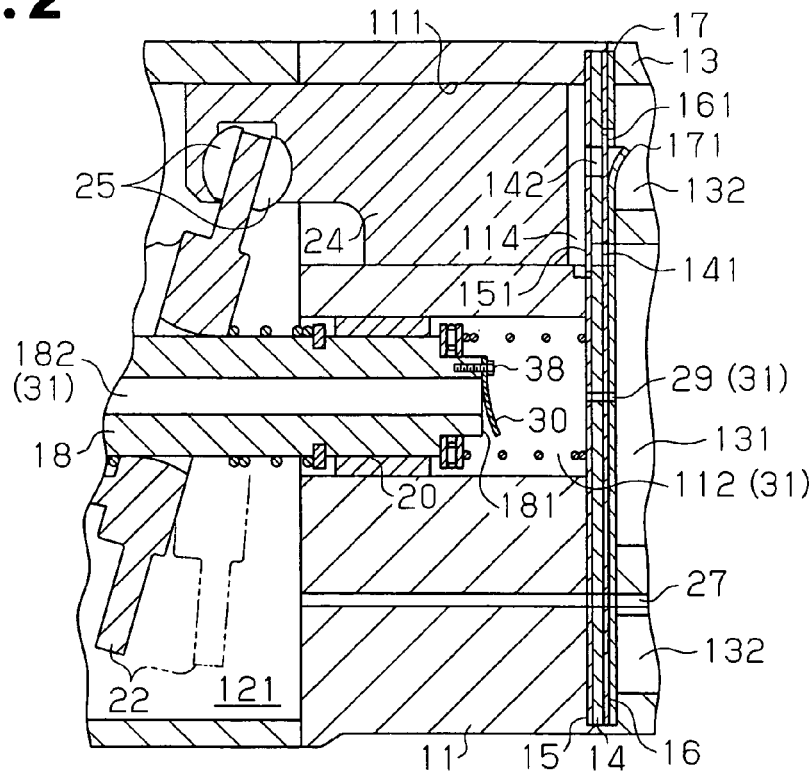
FIG. 2 is an enlarged cross-sectional view illustrating a variable displacement compressor according to a first modified embodiment.

As shown in FIG. 2, an on-off valve 30 made of a bimetal may be attached to the inner end 181 of the rotary shaft 18 with a screw 38. In this case, the on-off valve 30 changes its shape in response to temperature changes, so that selectively opens and closes the axial passage 182 at the inner end 181. Specifically, when the temperature of the on-off valve 30 is equal to or higher than a predetermined temperature, the on-off valve 30 closes the outlet of the axial passage 182 at the inner end 181.

Figure 3:
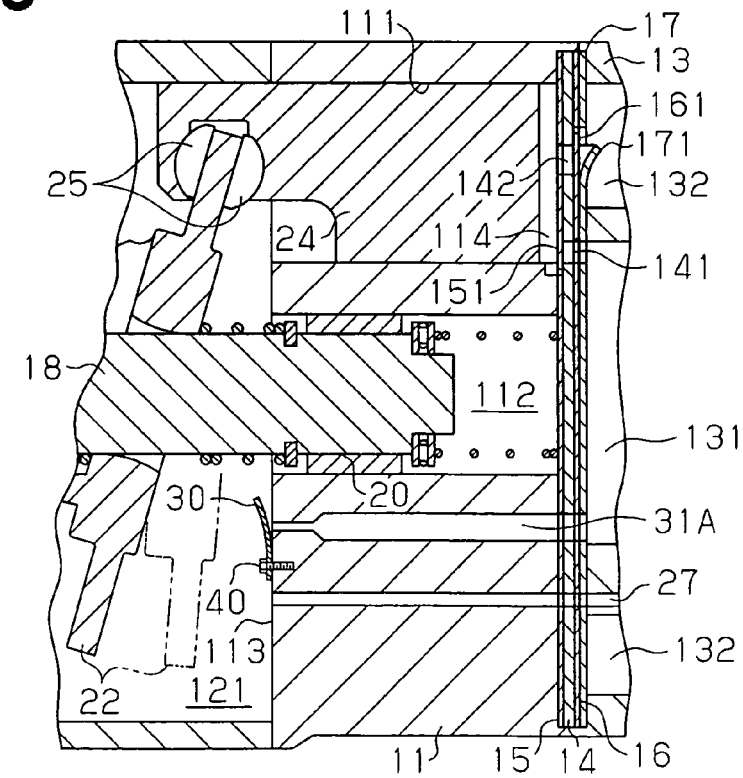
FIG. 3 is an enlarged cross-sectional view illustrating a variable displacement compressor according to a second modified embodiment.

In a modified embodiment shown in FIG. 3, the control pressure chamber 121 and the suction chamber 131 are connected to each other by a release passage 31A extending through the cylinder block 11, the valve flap plates 15, 16, the valve plate 14, and the retainer plate 17. An on-off valve 30 made of a bimetal is attached to an end face 113 of the cylinder block 11 that faces the control pressure chamber 121 by means of a screw 40. The release passage 31A is selectively opened and closed at the end face 113 by the on-off valve 30, which changes its shape in response to temperature changes. Specifically, when the temperature of the on-off valve 30 is equal to or higher than a predetermined temperature, the on-off valve 30 closes the inlet of the release passage 31A at the end face 113.

The on-off valve 30, which selectively opens and closes the release passage 31A extending though the cylinder block 11 is easily attached to the cylinder block 11 using the screw 40. The cylinder block 11 in which the release passage 31A is provided is suitable as a support portion for supporting the on-off valve 30.

The outlet of the communication passage 29 (the opening of the communication passage 29 that faces the suction chamber 131) may be closable with an on-off valve made of a bimetal.

A shape memory alloy may be used as the material of on-off valves that respond to temperature changes.

The present invention may be applied to a variable displacement compressor in which an electromagnetic displacement control valve is located on the release passage 31, 31A. In this case, when the opening degree of the electromagnetic displacement control valve is increased, the amount of refrigerant that flows out to the suction chamber 131 from the control pressure chamber 121 is increased, so that the pressure in the control pressure chamber 121 is lowered. Accordingly, the compressor displacement increases. When the opening degree of the control valve is reduced, the amount of refrigerant that flows out to the suction chamber 131 from the control pressure chamber 121 is decreased, so that the pressure in the control pressure chamber 121 is increased. Accordingly, the compressor displacement decreases.

The present invention may be applied to a wobble plate type variable displacement compressor as disclosed in Japanese Laid-Open Patent Publication No. 62-91672.

What is claimed is:

1. A variable displacement compressor, wherein the compressor draws a gaseous refrigerant from a suction pressure zone and discharges the gaseous refrigerant to a discharge pressure zone, and controls a displacement of the compressor according to a pressure in a control pressure chamber, the compressor comprising:

a cam body provided in the control pressure chamber, wherein an inclination angle of the cam body is changeable based on the pressure in the control pressure chamber;

a piston that reciprocates in a cylinder bore as the cam body rotates;

a supply passage for supplying the gaseous refrigerant in the discharge pressure zone to the control pressure chamber, wherein a flow passage area of the supply passage is controlled by an electromagnetic displacement control valve;

a release passage for discharging the gaseous refrigerant in the control pressure chamber to the suction pressure zone, the release passage operating to control the pressure in the control pressure chamber and the displacement;

an on-off valve that responds to changes in a temperature of the on-off valve to selectively open and close the release passage, wherein, when the temperature of the on-off valve is lower than a predetermined temperature, the on-off valve opens the release passage to allow the gaseous refrigerant to flow out to the suction pressure zone from the control pressure chamber through the release passage so that the pressure in the control pressure chamber is adjustable, and wherein, when the temperature of the on-off valve is equal to or higher than the predetermined temperature, the on-off valve shuts off the release passage to prevent the gaseous refrigerant from flowing out to the suction pressure zone from the control pressure chamber through the release passage so that the pressure in the control pressure chamber is increased to reduce the displacement, and wherein the predetermined temperature is greater than a vaporization temperature of the refrigerant, and, wherein the on-off valve is located in the control pressure chamber.

2. The compressor according to claim 1, wherein the on-off valve is made of a bimetal.

3. The compressor according to claim 1, wherein the piston defines a compression chamber in the cylinder bore, the compression chamber partitioned from the suction pressure zone and the discharge pressure zone by a partition wall, wherein, as the piston reciprocates, the piston draws the gaseous refrigerant from the suction pressure zone to the compression chamber and discharges the gaseous refrigerant from the compression chamber to the discharge pressure zone, wherein the partition wall has a communication passage that extends through the partition wall and forms at least part of the release passage, and wherein the on-off valve is supported by the partition wall, and closes an inlet or an outlet of the communication passage, thereby shutting off the release passage.

4. The compressor according to claim 1, further comprising a rotary shaft that supports the cam body in such manner that the cam body is integrally rotatable with the rotary shaft and inclinable, wherein the rotary shaft has an axial passage that forms at least part of the release passage, the axial passage having an outlet that opens at an inner end of the rotary shaft, and wherein the on-off valve is supported by the inner end of the rotary shaft, and closes the outlet of the axial passage, thereby shutting off the release passage.

5. The compressor according to claim 1, further comprising a cylinder block having the cylinder bore, wherein the release passage extends through the cylinder block to connect the control pressure chamber to the suction pressure zone, and wherein the on-off valve is supported by an end face of the cylinder block that faces the control pressure chamber, and closes an inlet of the release passage that opens at the end face of the cylinder block, thereby shutting off the release passage.

6. The compressor according to claim 1, wherein the predetermined temperature is set to a value that prevents a shortage of a lubricant in the gaseous refrigerant within the control pressure chamber.

7. The compressor according to claim 1, wherein the release passage is an only single passage for releasing the gaseous refrigerant to the suction pressure zone.

8. A variable displacement compressor having a predetermined minimum displacement and a predetermined maximum displacement, wherein the compressor draws a refrigerant from a suction pressure zone and discharges the a refrigerant to a discharge pressure zone, and controls a displacement of the compressor according to a pressure in a control pressure chamber, the compressor comprising:

a cam body provided in the control pressure chamber, wherein an inclination angle of the cam body is changeable based on the pressure in the control pressure chamber;

a piston that reciprocates in a cylinder bore as the cam body rotates;

a supply passage for supplying the refrigerant in the discharge pressure zone to the control pressure chamber, wherein a flow passage area of the supply passage is controlled by an electromagnetic displacement control valve;

a release passage for discharging the refrigerant in the control pressure chamber to the suction pressure zone, the release passage operating to control the pressure in the control pressure chamber and the displacement;

an on-off valve that responds to changes in a temperature of the on-off valve to selectively open and close the release passage, wherein, when the temperature of the on-off valve is lower than a predetermined temperature, the on-off valve opens the release passage to allow the refrigerant to flow out to the suction pressure zone from the control pressure chamber through the release passage so that the pressure in the control pressure chamber is adjustable, and wherein, when the temperature of the on-off valve is equal to or higher than the predetermined temperature, the on-off valve shuts off the release passage to prevent the refrigerant from flowing out to the suction pressure zone from the control pressure chamber through the release passage so that the pressure in the control pressure chamber is increased to reduce the displacement, and wherein the predetermined temperature is greater than a temperature of the refrigerant normally achieved during maximum displacement, and, wherein the on-off valve is located in the control pressure chamber.

* * * * *